US005582714A

United States Patent [19]

Forte

[11] Patent Number: 5,582,714

[45] Date of Patent: Dec. 10, 1996

[54] PROCESS FOR THE REMOVAL OF SULFUR FROM PETROLEUM FRACTIONS

[75] Inventor: Paulino Forte, Yonkers, N.Y.

[73] Assignee: UOP, Des Plaines, Ill.

[21] Appl. No.: 407,457

[22] Filed: Mar. 20, 1995

[51] Int. Cl.[6] ..... C10Y 29/20

[52] U.S. Cl. ..... 208/237; 208/227; 208/233

[58] Field of Search ..... 208/233, 237, 208/227

[56] References Cited

U.S. PATENT DOCUMENTS

| | | | |
|---|---|---|---|
| 2,514,997 | 7/1950 | Floyd | 196/24 |
| 2,634,230 | 4/1953 | Arnold et al. | 196/24 |
| 2,664,385 | 12/1953 | Wolff et al. | 196/31 |
| 2,792,332 | 12/1953 | Hutchings | 196/14.17 |
| 2,956,946 | 10/1960 | King et al. | 208/263 |
| 3,824,766 | 7/1974 | Valentine et al. | 55/48 |
| 3,837,143 | 9/1974 | Sutherland et al. | 55/32 |
| 3,915,674 | 10/1975 | Smith | 55/48 |
| 3,957,625 | 5/1976 | Orkin | 208/211 |
| 4,242,108 | 12/1980 | Nicholas et al. | 55/40 |
| 4,498,980 | 2/1985 | Forte | 208/321 |
| 4,781,820 | 11/1988 | Forte | 208/333 |
| 5,290,427 | 3/1994 | Fletcher et al. | 208/89 |
| 5,298,150 | 3/1994 | Fletcher et al. | 208/89 |

FOREIGN PATENT DOCUMENTS 569588 10/1977 U.S.S.R. .

*Primary Examiner*—Helane Myers

*Attorney, Agent, or Firm*—Thomas K. McBride; John G. Tolomei; Richard P. Silverman

[57] ABSTRACT

A process is disclosed for the removal of sulfur from petroleum fractions such as FCC gasoline by employing a solvent selected from the group consisting of a polyalkylene glycol, polyalkylene glycol ether, and mixtures thereof and having a molecular weight less than 400. The process is useful for saving energy, saving hydrogen consumption, and retaining octane. By requiring only the mild hydrotreatment of an extracted or absorbed stream concentrated with the sulfur impurities, the sulfur impurities are removed without the loss of octane resulting from conversion of either high octane olefins or aromatic components. In addition, the extract stream is a significantly smaller stream than the original feedstream.

18 Claims, 1 Drawing Sheet

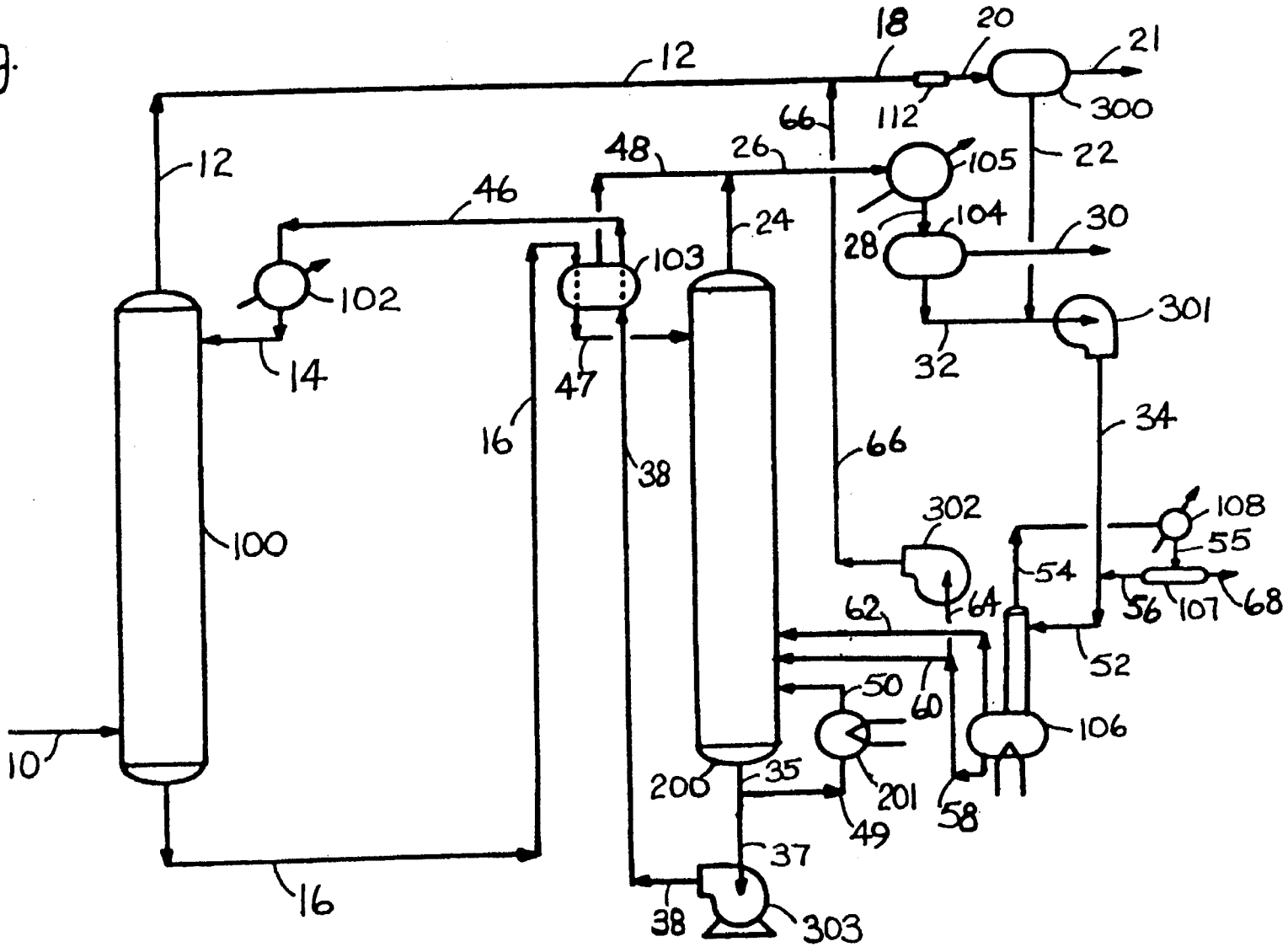
Fig.

PROCESS FOR THE REMOVAL OF SULFUR FROM PETROLEUM FRACTIONS

FIELD OF INVENTION

This invention relates to a process for the upgrading of hydrocarbon streams. More particularly the invention relates to a process for upgrading gasoline boiling range petroleum fractions containing substantial proportions of sulfur impurities.

BACKGROUND OF THE INVENTION

The removal of sulfur from petroleum fractions represents a major challenge in petroleum refining. Sulfur compounds, such as hydrogen sulfide, mercaptans, thiophenes, and elemental sulfur are impurities in petroleum fractions. If these impurities not removed from petroleum fractions, these sulfur impurities will corrode process equipment, impart poor color and odor properties to products, and poison downstream catalytic processes. The environmental impact of sulfur in various refining products may also be significant. For example, even though the current level of sulfur in motor gasoline is limited to less than 0.10 wt %, there are indications that even this level is not low enough to meet future standards for emissions from automobile exhaust. In a modem U.S. refinery, roughly over 50% of the gasoline pool comprises cracked gasoline produced from a fluid catalytic cracking (FCC) process. This makes FCC gasoline a major part of the gasoline product pool in the United States. Because FCC gasoline is produced from the heaviest and often the most sulfur-contaminated streams in the refinery, it provides a large portion of the sulfur in the gasoline product pool. The reduction of sulfur in gasoline, particularly to levels such as 300 ppm-wt as required to comply with environmental regulations are said to reduce automobile exhaust emissions of carbon monoxide, nitrogen oxides and hydrocarbons as well as sulfur oxides.

Naphthas and other light fractions such as heavy cracked gasoline may be hydrotreated by passing the feed over a hydrotreating catalyst at elevated temperature and somewhat elevated pressure in a hydrogen atmosphere. One suitable family of catalysts which has been widely used for this service is a combination of a Group VIII and a Group VI element, such as cobalt and molybdenum, on a substrate such as alumina. After the hydrotreating operation is complete, the product may be fractionated, or simply flashed, to release the hydrogen sulfide and collect the now sweetened gasoline.

Cracked naphtha, as it is produced from the FCC and without any further treatments such as purifying operations, has a relatively high octane number as a result of the presence of olefinic components. In some cases, this fraction may make a significant contribution to product octane. Hydrotreating of any of the sulfur-containing fractions which boil in the gasoline boiling range causes a reduction in the olefin content and, consequently, a reduction in the octane number. As the degree of desulfurization increases, the octane number of the normally liquid gasoline boiling range product decreases. Some of the hydrogen may also cause some hydrocracking as well as olefin saturation, depending on the conditions of the hydrotreating operation further lowering the octane of the fraction.

U.S. Pat. No. 2,514,997 to Floyd discloses a process for the removal of sulfur from a non-aromatic hydrocarbon feed using a solvent comprising a poly-olefin glycol having a molecular weight in the range of about 400 to 4,000 to produce a raffinate phase being substantially sulfur free.

U.S. Pat. No. 3,957,625 to Orkin discloses that the sulfur impurities tend to concentrate in the heavy portion of the cracked gasoline fraction. Orkin discloses a process wherein the cracked gasoline is fractionated to separate the heavy fraction of the catalytically cracked gasoline and hydrotreating the heavy fraction. Orkin does not attempt to recover octane lost in the hydrotreating of the heavy fraction.

Processes for removing sulfur without reducing the octane of the FCC gasoline and similar streams are disclosed in U.S. Pat. Nos. 5,298,150 and 5,290,427 Fletcher et al. wherein sulfur containing fraction of the FCC gasoline is desulfurized and the desulfurized fraction is contacted with an acidic catalyst to restore the octane of the desulfurized fraction. This process requires an energy intensive fractionation of the entire cracked gasoline stream to obtain the higher boiling fraction which contains the bulk of the sulfur impurities in the cracked gasoline.

U.S. Pat. No. 2,634,230 to Arnold et al. discloses a process for the desulfurization of high sulfur olefinic naphtha which Arnold teaches is the most difficult to desulfurize or otherwise refine by conventional methods. In the process 2,4-dimethyl sulfolane is employed to extract sulfur from a highly olefinic naphtha, such that the solvent does not affect separation between olefins and paraffins, to provide a sulfur lean raffinate phase and a sulfur rich extract. Both the raffinate and extract phases are distilled to remove the solvent and provide a dewatered raffinate and a dewatered extract. The dewatered extract is catalytically desulfurized and the resulting desulfurized extract is blended with the dewatered raffinate to provide a desulfurized naphtha product. Although Arnold avoids a costly fractionation step on the cracked gasoline stream, Arnold's process includes the costly distillation of both the extract and the raffinate streams to recover the sulfolane solvent.

U.S. Pat. No. 2,664,385 to Wolff et al. discloses a process for the extraction of organic sulfur compounds from a mixture thereof with hydrocarbons wherein the mixture is contacted with an ester of a thiosulfonic acid containing 2 to 20 hydrocarbons per molecule to provide a raffinate phase and an extract phase comprising the ester and the organic sulfur compound.

U.S. Pat. No. 2,956,946 to King et al. relates to a solvent extraction process for the removal of acid oils such as alkylated phenols, aerosols, xylenols, thiophenols and the like from petroleum distillates boiling between about 100° F. and about 900° F. by employing an ethylene glycol monoalkylamine ether to extract the acid oils and recover an acid-free raffinate. King et al. discloses that the acid oils were extracted by the solvents in preference to aromatics regardless of the conditions employed. King et al. discloses a process whereby the feedstream containing the acid oils is contacted in an extraction zone with a solvent to provide a raffinate stream and a rich solvent stream. The raffinate stream is water washed to provide a treated petroleum distillate and a water and solvent stream. The water and solvent stream is passed to a settling zone where the water and solvent stream is contacted with the rich solvent stream to provide an aromatics fraction and a second rich solvent stream. The second rich solvent stream is passed to a distillation column to separate water from the second rich solvent stream to provide an anhydrous rich solvent stream. The anhydrous rich solvent stream is passed to a vacuum tower to separate the acid oils and to provide a lean solvent stream. The lean solvent stream and a portion of the anhydrous rich solvent stream are returned to the extraction zone.

U.S. Pat. No. 2,792,332 to Hutchings discloses a process for the removal of aromatics and sulfur compounds from a feedstream comprising heavy naphtha, aromatics and sulfur compounds wherein the feedstream comprising heavy naphtha is contacted in a first extraction column with a solvent combination comprising isopropyl alcohol and polyethylene glycol having a molecular weight of about 600, in volume percent ratio of about 70 to 30 of glycol to alcohol, respectively, to obtain a concentrated aromatic fraction and a paraffinic-naphthenic raffinate. Hutchings recycles the raffinate for reprocessing with the feedstream. The raffinate is first distilled to remove the alcohol, and the resulting alcohol depleted raffinate is water washed to remove traces of the polyethylene glycol 600 and then dried. The extract phase is similarly processed to first remove the alcohol by distillation and the alcohol-free extract is steam distilled to recover an aromatic product and to provide an aromatic-free polyethylene glycol/water stream. The polyethylene glycol/water stream is then passed to a solvent recovery tower to distill off the remaining water. In a second extraction column, the concentrated aromatic fraction is contacted with pure polyethylene glycol to recover an aromatic extract and the aromatic extract is steam distilled to provide a purified aromatic product comprising aromatic sulfur-type compounds.

U.S. Pat. No. 4,781,820 to Forte and U.S. Pat. No. 4,498,980 to Forte et al. disclose processes for the separation of aromatic and non-aromatic hydrocarbons from a mixed hydrocarbon feed wherein the feedstream is contacted with a solvent comprising a polyalkylene glycol and a co-solvent comprising a glycol ether. The U.S. Pat. Nos. 4,781,820 and 4,498,980 are hereby incorporated by reference.

In any case, regardless of the mechanism by which it happens, the decrease in octane which takes place as a consequence of sulfur removal by hydrotreating creates a conflict between the growing need to produce gasoline fuels with higher octane number and—because of current ecological considerations - the need to produce cleaner burning, less polluting fuels, especially low sulfur fuels.

Processes are sought for the efficient removal of sulfur compounds from FCC gasoline and similar petroleum refinery streams without the loss of gasoline octane yield and quality, and at a minimum reprocessing cost.

SUMMARY

It is a broad object of this invention to provide an effective means for removing sulfur contaminants from petroleum streams such as FCC gasoline. By the process of the present invention the sulfur contaminants are efficiently concentrated into a smaller stream and the much smaller stream may be further treated in a mild desulfurization step to remove the sulfur without the accompanying loss of valuable octane quality.

In one embodiment the invention relates to a process for the removal of sulfur impurities from a mixture thereof with FCC gasoline. The process comprises contacting the mixture in an extraction zone with a lean solvent including a component selected from the group consisting of a poly alkylene glycol, a polyalkylene glycol ether, and mixtures thereof having a molecular weight less than about 400 to provide a raffinate stream having a reduced sulfur content relative to the mixture and a rich-solvent stream enriched in the sulfur impurities. The rich-solvent stream is passed to a stripping zone wherein the rich-solvent stream is contacted with a stripping medium to produce an extract phase comprising sulfur impurities and a stripped solvent stream depleted of the impurities. The extract phase is separated into an extract product and a first aqueous phase. The raffinate stream is washed with at least a portion of the first aqueous phase to provide a raffinate product and a second aqueous phase. At least a portion of the second aqueous phase is passed to the stripping zone as the stripping medium. At least a portion of the stripped solvent stream is returned to the extraction zone as the lean solvent.

In a further embodiment the invention is a process for the extraction of sulfur compounds from a hydrocarbon feedstream comprising FCC gasoline and sulfur compounds. The process comprises passing the hydrocarbon feedstream to an extraction zone and therein contacting the feedstream with a first lean selective solvent including a component selected from the group consisting of tetraethylene glycol, penta ethylene glycol, methoxytriglycol, and mixtures thereof to provide a rich-solvent stream enriched in sulfur relative to the hydrocarbon feedstream and a raffinate stream. The rich-solvent stream is passed to a reboiled flash zone to provide a first overhead stream and a second rich-solvent stream. The second rich-solvent stream is passed to a reboiled distillation zone and therein the second rich-solvent stream is contacted with a stripping medium to provide a second lean solvent stream and a second overhead stream comprising hydrocarbons and sulfur compounds. The first overhead stream and at least a portion of the second overhead stream are admixed to provide a mixed overhead stream. The mixed overhead stream is cooled and condensed to provide a sulfur-rich hydrocarbon stream and a first aqueous stream. At least a portion of the first aqueous stream is admixed with the raffinate stream to provide a raffinate admixture. The raffinate admixture is cooled and condensed to provide a lean hydrocarbon stream and a second aqueous stream. At least a portion of the second aqueous stream is passed to the reboiled distillation zone to provide the stripping medium. At least a portion of the second lean solvent stream is returned to the extraction zone to provide the first lean solvent stream.

BRIEF DESCRIPTION OF THE DRAWINGS

FIG. 1 is a process flow diagram of the process arranged in accordance with the present invention

DETAILED DESCRIPTION

The feed to the process comprises a sulfur-containing petroleum fraction which boils in the gasoline boiling range. Feeds of this type include light naphthas typically having a boiling range of about $C_6$ to 330° F. (166° C.); full range naphthas, typically having a boiling range of about $C_5$ to 420° F. (216° C.), heavier naphtha fractions boiling in the range of about 260° F. (127° C.) to 412° F. (211° C.), or heavy gasoline fractions boiling at, or at least within, the range of about 330° (166° C.) to 500° F. (260° C.), preferably about 330° F. (166° C.) to 412° F. (211° C.). While the most preferred feed appears to be a heavy gasoline produced by catalytic cracking; or a light or full range gasoline boiling range fraction, the best results are obtained when, as described below, the process is operated with a gasoline boiling range fraction which has a 95 percent point (determined according to ASTM D 86) of at least about 325° F. (163° C.) and preferably at least about 350° F. (177° C.), for example, 95 percent points of at least 380° F. (about 193° C.) or at least about 400° F. (about 220° C.).

The process may be operated with the entire gasoline fraction obtained from the catalytic cracking step or, alternatively, with part of it, depending on the amount and the identity of the sulfur compounds present. If the front end of the cracked fraction contains relatively few sulfur components, it may be possible to separate the higher boiling fractions and process them through the steps of the present process without processing the lower boiling cut. The cut point between the treated and untreated fractions may vary according to the sulfur compounds present but usually, a cut point in the range of from about 100° F. (38° C.) to about 300° F. (150° C.), more usually in the range of about 200° F. (93° C.) to about 300° F. (150° C.) will be suitable. The exact cut point selected will depend on the sulfur specification for the gasoline product as well as on the type of sulfur compounds present; lower cut points will typically be necessary for lower product sulfur specifications.

The sulfur which is present in components boiling below about 150° F. (65° C.) is mostly in the form of mercaptans which may be removed by extractive type processes which convert the mercaptans to disulfides and extract the disulfides, but hydrotreating is appropriate for the removal of thiophene and other cyclic sulfur compounds present in higher boiling components, e.g., component fractions boiling above 180° F. (82° C.). Typically, the mercaptan sulfur will include methyl mercaptan, ethyl mercaptan, propyl mercaptan, butyl mercaptan, higher mercaptans, and mixtures thereof; and the concentration of mercaptan sulfur compounds in the hydrocarbon feedstream will range from about 1 to about 500 ppm wt. Treatment of the lower boiling fraction in an extractive type process coupled with hydrotreating of the higher boiling component may therefore represent a preferred economic process option. Higher feed cut points will be preferred in order to minimize the amount of feed which is passed to the hydrotreater and the final selection of cut point together with other process options such as the extractive type desulfurization will therefore be made in accordance with the product specifications, feed constraints and other factors.

The sulfur content of these catalytically cracked fractions will depend on the sulfur content of the feed to the cracker as well as on the boiling range of the selected fraction used as the feed in the process. Lighter fractions, for example, will tend to have lower sulfur contents than the higher boiling fractions. As a practical matter, the sulfur content will exceed 50 ppm-wt and usually will be in excess of 100 ppm-wt and in most cases in excess of about 500 ppm-wt. For the fractions which have 95 percent points over about 380° F. (193° C.), the sulfur content may exceed about 1,000 ppm-wt and may be as high as 4,000 to 5,000 ppm-wt or even higher, as shown below. The nitrogen content is not as characteristic of the feed as the sulfur content and is preferably not greater than about 20 ppm-wt although higher nitrogen levels typically up to about 50 ppm-wt may be found in certain higher boiling feeds with 95 percent points in excess of about 380° F. (193° C.). The nitrogen level will, however, usually not be greater than 250 or 300 ppm-wt. As a result of the cracking which has preceded the steps of the present process, the feed to the hydrodesulfurization step will be olefinic, with an olefin content of at least 5 and more typically in the range of 10 to 20, e.g. 15–20, weight percent.

In the process of the present invention, the extract stream, a much smaller stream than the feed to the extraction zone, will be enriched in sulfur compounds and aromatic hydrocarbons relative to the fraction of the FCC gasoline being treated. The extract stream is further processed in a mild hydrotreating zone to remove the sulfur compounds providing a hydrotreated extract stream without significantly altering the octane number of the recombined raffinate and hydrotreated extract stream by hydrotreating at conditions which do not saturate the aromatic content of the extract stream. Although some of the olefins in the extract will be converted to paraffins in the mild hydrotreating step, the overall loss of the total FCC gasoline will be minimal when the hydrotreated extract is recombined with the raffinate in the gasoline pool. The mild hydrotreating step may be carried out in the conventional manner by passing the extract stream at a temperature ranging from about 220° C. to about 450° C. and a pressure ranging from about 445 kPa to about 10.4 MPa (50 psia to 1500 psia) over a conventional desulfurization catalyst prepared from a Group VI and/or a Group VIII metal on a suitable substrate. Combinations such as Ni—Mo or Co—Mo are typical. The support for the desulfurization catalyst is conventionally an alumina, or silica-alumina, but other porous solids such as magnesia, titania or silica—either alone or mixed with alumina or silica-alumina—may be used. The space velocity-for the mild hydrodesulfurization step is typically about 0.5 to about 10 LHSV ($hr^{-1}$), based on the total feed and the total catalyst volume. The hydrogen to hydrocarbon ratio in the feed is typically about 500 to about 5000 SCF/Bbl (about 90 to 900 N1/1) based on the total feed to the hydrotreater and hydrogen volumes. The extent of desulfurization will depend on the extract sulfur content and the product sulfur specification.

SOLVENTS

Solvents acceptable for the instant invention should be able to remove sulfur compounds, particularly organosulfur components such as mercaptans, sulfides, disulfides, thiophenes, benzothiophenes, and mixtures thereof from hydrocarbon feedstreams derived from petroleum fractions in the gasoline boiling range. The selective solvent of the present invention selectively removes sulfur compounds such as mercaptans, sulfides, thiophenes, and mixtures thereof from a hydrocarbon feedstream. The liquid-liquid extraction zone may operate at a capacity and efficiency necessary to remove essentially all of the sulfur compound impurities. The selective solvents employed in the instant invention, in general, are water-miscible organic liquids at the operating temperature of the process. Furthermore, the selective solvents must have a boiling point and a decomposition temperature higher than the operating temperature of the process, wherein the operating temperature of the process refers to the liquid-liquid extraction temperatures at which the feedstock is contacted with the solvent. The term "water-miscible" describes those solvents which are completely miscible with water over a wide range of temperatures, which have a high partial miscibility with water at room temperature, and which are completely miscible with water at operating temperatures. By the term "essentially all of the sulfur compounds," it is meant that the sulfur content of the treated stream is preferably less than 200 ppm-wt sulfur and more preferably that it is less than 100 ppm-wt, and most preferably that it is less than 50 ppm-wt.

The selective solvents employed in the instant invention are low molecular weight, preferably having a molecular weight less than about 400 and more preferably having a molecular weight less than about 200. Examples of such solvents include polyalkylene glycols of the formula:

$$HO—[CHR_1—(CR_2R_3)_n—O—]_m—H$$

wherein n is an integer from 1 to 5 and is preferably the integer 1 or 2; m is an integer having a value of 1 or greater, preferably between about 1 to about 20 and most preferably between about 1 and about 8; and wherein $R_1$, $R_2$, and $R_3$ may be hydrogen, arkyl, aryl, aralkyl or alkylaryl and are preferably hydrogen and alkyl having between 1 and about 10 carbon atoms and most preferably are hydrogen. Examples of the polyalkylene glycol solvents employable herein are diethylene glycol, triethylene glycol, tetraethylene glycol, pentaethylene glycol, 1,3-butane glycol, 1,2-butane glycol, 1,5-pentane glycol, water, and mixtures thereof and the like. In addition to the polyalkylene glycol solvents, the solvent may be selected from the group consisting of sulfolane, furfural, n-formyl morpholine, n-methyl-2pyrrolidone. Preferred solvents are diethylene glycol, triethylene glycol, tetraethylene glycol, pentaethylene glycol, water, and mixtures thereof, with pentaethylene glycol being most preferred. In addition, such solvents may be combined with a cosolvent component having a low molecular weight, preferably less than 400 and more preferably having a molecular weight less than about 200. Examples of such cosolvents include a glycol ether of the formula:

$$R_4O—[CHR_5—(CHR_6)_x—O]_y—R_7$$

wherein $R_4$, $R_5$, $R_6$, and $R_7$ may be hydrogen, alkyl, aryl, aralkyl, alkylaryl, and mixtures thereof with the proviso that $R_4$ or $R_7$ are not both hydrogen. The value of x is an integer from 1 to 5 preferably 1 or 2 and y may be an integer from 1 to 10 and is preferably from 2 to 8, and most preferably from 2 to 5 $R_4$, $R_5$, $R_6$, and $R_7$ are preferably selected from the group consisting of hydrogen and alkyl having 1 to about 10 carbons with the proviso that $R_4$ and $R_7$ may not both be hydrogen and most preferably $R_4$ is alkyl having from 1 to 5 carbons and $R_5$, $R_6$, and $R_7$ are hydrogen.

DESCRIPTION OF THE DRAWING

The process of the present invention is hereinafter described with reference to the drawing which illustrates various aspects of the process. It is to be understood that no limitation to the scope of the claims which follow is intended by the following description. Those skilled in the art will recognize that these process flow diagrams have been simplified by the elimination of many necessary pieces of process equipment including some heat exchangers, process control systems, pumps, fractionation systems, etc. It may also be discerned that the process flow depicted in the figures may be modified in many aspects without departing from the basic overall concept of the invention.

With reference to the figure, a feedstream comprising an FCC gasoline with compounds including organosulfur components is passed via line 10 to a recovery zone 100. In this context, the amount of sulfur in the FCC gasoline ranges between 50 and 3000 ppm-wt sulfur. In the recovery zone 100, the feedstream 10 is contacted with a lean solvent in line 14 which has been chilled in cooler 102 to a temperature of between 50° C. and 200° C. A raffinate stream in line 12—being essentially free of mercaptans and sulfides is withdrawn from the top of the recovery zone and passed to a water-wash zone 300 via lines 12, 18 and 20. An in-line mixer 112 facilitates the admixing of the raffinate in line 12 with wash water stream 66. The wash water stream 66 is introduced to the raffinate stream in line 12 to remove any traces of the solvent which might have remained in stream 18 and the resulting mixture is separated in water-wash zone 300 into a product stream which is withdrawn in line 21 and a water phase which is withdrawn in line 22. A rich solvent stream is withdrawn from the recovery zone 100 via line 16 and passed to a reboiled flash zone 103 wherein the rich solvent stream is heated and flashed by cross exchange with hot, lean solvent stream 38 and passed in line 47 to the top of a stripping zone 200. In the stripping zone the liquid from the reboiled flash zone is contacted with a stripping medium which is introduced to the stripping zone 200 via lines 60 and 62. A bottom stream is withdrawn from the stripping zone in line 35. A portion of the bottoms stream 35 is passed via line 49 through reboiler 201 and reboiled bottoms 50 is returned to the stripping zone 200. The net bottoms 37 is passed through pump 303 and via line 38 to reboiled flash zone 103 wherein heat from the bottoms stream 38 is transferred to the rich solvent stream 16 to at least partially vaporize the rich solvent stream in line 47. This cross exchange of heat results in a first cooled lean solvent stream in line 46 which is then passed to cooler 102 which further cools the lean solvent stream and provides the lean solvent stream in line 14 which is returned to the recovery zone 100 as hereinabove described. A vapor stream 48 is produced in the reboiled flash zone 103 acting as a kettle reboiler wherein a portion of the rich solvent is vaporized which then serves to further cool the first cooled lean solvent stream 46. The overhead vapor stream 24 from the stripping zone 200 is combined with the vapor stream 48 withdrawn from the reboiled flash zone 103 and the admixture is passed via line 26 to overhead condenser 105. A cooled overhead stream in line 28 is passed to accumulator 104. In accumulator 104 the hydrocarbon phase is withdrawn via line 30 as the extract stream and the aqueous phase comprising water soluble sulfur compounds is passed via line 32 and combined with line 22 comprising solvent recovered from the raffinate wash 300 and the admixture is passed via lines 34 and 52 to a water still 106. The water still 106 by means of reboiling with such available medium as low pressure steam provides a rejected stream 54 comprising sulfur compounds which is passed overhead in line 54 to condenser 108 and the cooled overhead 55 is passed to accumulator 107. A condensed stream 68 comprising the sulfur compounds withdrawn from accumulator 107 may be passed to a refinery sour water system for further disposal. A portion of the condensed stream 56 is withdrawn from accumulator 107, admixed with line 34, and returned to the water still 106 in line 52. Vapor water stream 62 is returned to the stripping zone 200 and liquid water stream 58 is split such that a portion is passed via line 60 to be returned to the stripping zone 200 and a portion is passed via lines 64 and 66 and pump 302 to provide wash water for the raffinate stream 12.

In the above described scheme, the recovery zone may be operated as a liquid-liquid extraction zone wherein the feed stream is introduced as a liquid hydrocarbon stream. In this operation, the liquid-liquid extraction zone 100 typically is operated at conditions to maintain all of the streams in liquid state. Such operation would include a pressure ranging from approximately 200 kPa (30 psia) to approximately 1.1 MPa (165 psia) and a temperature ranging from about 20° C. to approximately 200° C. The operation of the stripping zone 200 may be characterized by operating conditions including a pressure ranging from about 20 kPa (3 psia) to approximately 450 kPa (65 psia) and a temperature ranging from approximately 100° C. to approximately 250° C. The water still 114 is conventionally operated at temperatures ranging from 20° C. to approximately 140° C. and a pressure ranging from 20 kPa (3 psia) to approximately 450 kPa (65 psia).

In an alternate embodiment, referring to the above figure, stream 10 may be passed to the recovery zone 100 as a vaporized stream which is at least partially vaporized and the recovery zone is operated as a gas absorption zone having an absorption temperature ranging from 100° C. to about 235° C. and an absorption pressure ranging from 20 kPa to about 430 kPa.

The invention will be further clarified by a consideration of the following examples, which are intended to be purely exemplary of the use of the invention.

EXAMPLES

Other embodiments of the invention will be apparent to the skilled in the art from a consideration of this specification or practice of the invention disclosed herein. It is intended that the specification and examples be considered as exemplary only, with the true scope and spirit of the invention being indicated by the following claims.

EXAMPLE I

A single-stage wash procedure for determining the degree of sulfur removal from a petroleum fraction in a single-stage of extraction was carried out in the following manner. A 100 ml sample of the hydrocarbon was poured into a 500 ml separatory funnel. An appropriate volume amount of solvent, according to a desired solvent to feed ratio was added to the funnel and the contents were mixed thoroughly for about 5 minutes. The phases were permitted to separate and the contents were mixed again for about 5 minutes. The mixing and phase separation were continued until the mixing time had reached a total of 25 minutes. The phases were collected and analyzed for the amount of hydrocarbon and sulfur in the solvent phase.

According to the above procedure, a sample of a light FCC gasoline with an ASTM initial boiling point (IBP) of 27° C. (80° F.) and an end point of about 82° C. (180° F.) containing about 2 vol-% aromatics, about 45% olefins and having a total sulfur content of 464 ppm-wt was evaluated with varying solvent to feed ratios for three solvents. The solvents tested were tetra-ethylene glycol (TETRA), penta-ethylene glycol (PENTA), and a 75:25 mixture of tetraethylene glycol and methoxytriglycol (MIXED). The results are shown in Table 1 for solvent to feed ratios varying from 1:1 to 3:1. Determinations were made at 22° C. and at 60° C. for the TETRA solvent. At 22° C., the sulfur removal ranged from 28 to 49% as the solvent to feed ratio was increased from 1:1 to 3:1 and the amount of hydrocarbon in the solvent phase increased from 6 to 18 vol-%. At 60° C., the results for TETRA showed that for a 3:1 solvent to feed ratio, the sulfur removal increased to 57% and the entrained hydrocarbon phase was reduced to about 10 vol-%. Using the pentaethylene glycol (PENTA) solvent showed that the sulfur removal ranged from 38 to 72 wt-% for solvent to feed ratios from 1:1 to 3:1. Surprisingly, the MIXED solvent showed an even higher sulfur removal at the low solvent to feed ratio, 82 percent higher than TETRA alone and 34 percent higher than PENTA. At a solvent to feed ratio of 3:1 the use of the MIXED solvent resulted in a 75% sulfur removal with an entrainment of about 22% of the hydrocarbon phase, resulting in a hydrocarbon phase having a sulfur content of 150 ppm-wt. The molecular weights of the solvents tested ranged from about 187 to 240.

TABLE 1

SOLVENT EXTRACTION OF LIGHT FCC GASOLINE
Sulfur Content: 464 ppm-wt

| | | | SINGLE WASH AT INDICATED VOLUME RATIO | | | | | | | | |
|---|---|---|---|---|---|---|---|---|---|---|---|
| | | | 1:1 | | | 2:1 | | | 3:1 | | |
| SOLVENT | AVE MW | T,°C. | ppm | HC % | Sulf % | ppm | HC % | Sulf % | ppm | HC % | Sulf % |
| TETRA | 194.2 | 22 | 356 | 6% | 28% | 322 | 12% | 39% | 289 | 18% | 49% |
| TETRA | 194.2 | 60 | 400 | 7% | 20% | 304 | 12% | 42% | 262 | 10% | 57% |
| PENTA | 238.3 | 22 | 308 | 7% | 38% | 180 | 15% | 67% | 169 | 22% | 72% |
| MIXED | 186.7 ave | 22 | 246 | 8% | 51% | 197 | 17% | 65% | 150 | 22% | 75% |

TETRA - Tetraethylene glycol
PENTA - Pentaethylene glycol
MIXED - 75 vol-% TETRA/25 vol-% methoxytriglycol

EXAMPLE II

A single-stage wash of the full boiling range FCC gasoline having a nominal ASTM IBP of 36° C. (96° F.), a 50% point of 99° C. (211° F.) and an end point of 217° C. (422° F.) with 22 vol-% aromatics and about 29 vol-% olefins and 677 ppm-wt sulfur was evaluated according to the procedure of Example I at 22° C. with TETRA, PENTA, and the MIXED solvents for solvent to feed ratios of 1:1 to 3:1. The results for the full boiling FCC gasoline are shown in Table 2. At the 1:1 solvent to feed ratio, the MIXED solvent sulfur removal was 20% higher than the TETRA and 10% higher than the PENTA solvents. As the solvent to feed ratio was increased, the sulfur removal rates were above 60 percent for all the solvents and the entrained hydrocarbon amounts ranged from 20 to 24 vol-%.

TABLE 2

EXTRACTION OF FULL BOILING RANGE FCC GASOLINE
Sulfur Content: 677 ppm-wt

| | | | SINGLE WASH AT INDICATED VOLUME RATIO | | | | | | | | |
|---|---|---|---|---|---|---|---|---|---|---|---|
| | | AVE | 1:1 | | | 2:1 | | | 3:1 | | |
| SOLVENT | T,°C. | MW | ppm | HC % | Sulf % | ppm | HC % | Sulf % | ppm | HC % | Sulf % |
| TETRA | 22 | 194 | 462 | 7% | 36% | 368 | 14% | 53% | 315 | 20% | 63% |
| PENTA | 22 | 238 | 453 | 9% | 39% | 343 | 20% | 59% | 269 | 25% | 70% |
| MIXED | 22 | 187 | 427 | 10% | 43% | 365 | 19% | 56% | 285 | 24% | 68% |

EXAMPLE III

A 100 gm sample of heavy FCC gasoline with an initial boiling point of about 160° C. (320° F.) and an end point the same as the full range gasoline of Example II and having a sulfur content of 2200 ppm-wt was mixed with 100 gm of TETRA at 100° C. according to the single-wash procedure of Example I. The single-wash extraction at a 1:1 solvent to feed ratio removed about 37 wt-% of the sulfur yielding 88 gms of raffinate with a sulfur content of 1602 ppm-wt and 12 gms of extract with a sulfur content of 6833 ppm-wt.

EXAMPLE IV

The procedure of Example II was repeated with 200 gms of TETRA at 100° C. to yield 71.8 gms of raffinate with a sulfur content of about 710 ppm-wt and 28.2 gms of extract with a sulfur content of about 5993 ppm-wt. This corresponds to about 77 wt-% sulfur removal based on the sulfur content of the extract at a solvent to feed ratio of 2:1.

EXAMPLE V

An engineering simulation of the process based on the single-wash data of Examples I and II for the present invention as shown in the Figure was developed for treating about 20,000 barrels per day (99.4 MKg/hr) of FCC gasoline. The total sulfur in the FCC gasoline is about 500 ppm wt, comprising mercaptans and thiophenes. The FCC gasoline stream is passed to a liquid-liquid extraction zone at a temperature of about 121° C. and a pressure of about 830 kPa. In the extraction zone, the FCC gasoline is contacted with tetraethylene glycol (TETRA) at a solvent to feed value ratio of about 2.2. A raffinate stream at a volumetric yield of 76 percent with a total sulfur content of about 111 ppm-wt is withdrawn from the stripping zone. The extract stream having a total sulfur content of about 1,620 ppm-wt is hydrotreated at mild conditions to remove essentially all of the sulfur from the extract and is recombined with the raffinate to provide a treated gasoline stream having a sulfur content of about 82 ppm-wt. Table 3 presents an overall material balance for Example V and indicates the percent removal of the components from the feedstream. Essentially all of the mercaptans and about 82.8 percent of the thiophenes in the feedstream are removed from the raffinate in the extraction step. In addition, about half or 53.6 percent of the aromatics are removed from the feedstream along with minor amounts of paraffins, olefins, and naphthenes. Because the aromatics in the extract were largely light ($C_6$–$C_8$) aromatics such as benzene, toluene, and xylene, and the extract contained a minor portion (about 16.3%) of olefins, there is very little octane loss in the mild hydrotreating step. None of the octane of the light aromatics is lost at the mild hydrotreating conditions.

The energy consumption for the extraction process is about 150 MMkJ/hr of treated gasoline with approximately 77 percent of the energy supplied by low pressure saturated stream at 275 kPa pressure.

TABLE 3

EXTRACTION OF SULFUR COMPOUNDS
FROM FCC GASOLINE WITH 500 PPM SULFUR

| COMPOUNDS | FCC GASOLINE WT % | RAFFINATE WT % | EXTRACT WT % | % REMOVAL |
|---|---|---|---|---|
| Paraffins | 31.410 | 38.569 | 10.833 | 8.9 |
| Olefins | 31.200 | 35.220 | 19.643 | 16.3 |
| Naphthenes | 5.130 | 6.113 | 2.304 | 11.6 |
| Aromatics | 32.090 | 20.062 | 66.664 | 53.6 |
| Mercaptans | 0.016 | — | 0.062 | 100.0 |
| Thiophenes | 0.154 | 0.036 | 0.494 | 82.8 |
| TOTAL | 100.00 | 100.00 | 100.00 | 25.8 |
| Flow Rates, MKg/hr | 99.44 | | 25.66 | |
| Sulfur, ppm wt | 500 | 111 | 1620 | 83.6 |
| Sulfur, ppm wt in Treated Gasoline | 82 | 73.78 | | |
| EXTRACTION CONDITIONS | | | | |
| Solvent/Feed, Kg/Kg | | 3.2 | | |
| Solvent/Feed, Vol/Vol | | 2.2 | | |
| Temperature, °C. | | 49 | | |
| No. of Trays | | 60 | | |

TABLE 3-continued

| EXTRACTION OF SULFUR COMPOUNDS FROM FCC GASOLINE WITH 500 PPM SULFUR | | | | |
|---|---|---|---|---|
| COMPOUNDS | FCC GASOLINE WT % | RAFFINATE WT % | EXTRACT WT % | % REMOVAL |
| STRIPPING CONDITIONS | | | | |
| Temperature, °C. | | 182 | | |
| Pressure, kPa | | 41 | | |
| No. of Trays | | 10 | | |
| ENERGY CONSUMPTION | | | | |
| MMkJ/hr | | 150 | | (142.2 MM BTU/hr) |

EXAMPLE VI

In Example VI, a liquid extraction scheme is evaluated for the processing of an FCC gasoline stream having 1500 ppm wt sulfur compounds. The results are shown in Table 4. As in Example V, the FCC gasoline to be treated is passed to an extraction zone to provide a raffinate stream depleted in sulfur compounds containing about 130 ppm wt sulfur and an extract stream containing about 4052 ppm wt sulfur. After a mild hydrotreating step the extract stream and the raffinate are combined to provide the treated FCC gasoline stream with a total of 85 ppm wt sulfur. The energy requirement for processing the feedstream of Example V is about 212 MMkJ/hr, of which about 78% is supplied by saturated stream at about 275 kPa.

TABLE 4

| EXTRACTION OF SULFUR COMPOUNDS FROM FCC GASOLINE WITH 1500 PPM SULFUR | | | | |
|---|---|---|---|---|
| COMPOUNDS | FCC GASOLINE WT % | RAFFINATE WT % | EXTRACT WT % | % REMOVAL |
| Paraffins | 31.410 | 42.232 | 11.243 | 12.5 |
| Olefins | 31.200 | 36.932 | 20.518 | 23.0 |
| Naphthenes | 5.130 | 6.580 | 2.428 | 16.5 |
| Aromatics | 32.090 | 14.213 | 64.430 | — |
| Mercaptans | 0.016 | — | 0.139 | 100.0 |
| Thiophenes | 0.154 | 0.043 | 1.242 | 94.0 |
| TOTAL | 100.00 | 100.00 | 100.00 | 34.9 |
| Flow Rates, MKg/hr | 99.44 | 64.72 | 34.72 | |
| Sulfur, ppm wt | 1500 | 130 | 4052 | 94.3 |
| Sulfur, in treated gasoline, | 85 | | | |
| EXTRACTION CONDITIONS | | | | |
| Solvent/Feed, Kg/Kg | | 4.5 | | |
| Solvent/Feed, Vol/Vol | | 3.02 | | |
| Temperature, °C. | | 49 | | |
| No. of Trays | | 60 | | |
| STRIPPING CONDITIONS | | | | |
| Temperature, °C. | | 182 | | |
| Pressure, kPa | | 41 | | |
| No. of Trays | | 10 | | |
| ENERGY CONSUMPTION | | | | |
| MM kJ/hr | | 212 | (201.1 MM BTU/Hr) | |

I claim:

1. A process for the removal of sulfur impurities from a mixture thereof with an FCC gasoline fraction said process comprising:

a) contacting said mixture in an extraction zone with a lean solvent selected from the group consisting of a polyalkylene glycol, a polyalkylene glycol ether and mixtures thereof having a molecular weight less than 400 to provide a raffinate stream having a reduced sulfur content relative to said mixture and a rich-solvent stream enriched in said sulfur impurities;

b) passing said rich-solvent stream to a stripping zone and therein contacting said rich-solvent stream with a stripping medium to produce an extract phase comprising said sulfur impurities and a stripped solvent stream depleted of said impurities;

c) separating said extract phase into an extract product and a first aqueous phase;

d) washing said raffinate stream with at least a portion of said first aqueous phase to provide a raffinate product and a second aqueous phase;

e) passing at least a portion of said second aqueous phase to said stripping zone as said stripping medium; and, f) returning at least a portion of said stripped solvent stream to said extraction zone as said lean solvent.

2. The process of claim 1 further comprising desulfurizing said extract product in a mild hydrotreating operation to produce a desulfurized extract stream and recombining said desulfurized extract stream with said raffinate product to produce a desulfurized FCC gasoline stream.

3. The process of claim 2 wherein said lean solvent is selected from the group consisting of tetraethylene glycol, pentaethylene glycol, methoxytriglycol, and mixtures thereof.

4. The process of claim 1 wherein said solvent comprises a polyalkylene glycol of the formula:

$$HO—[CHR_1—(CR_2R_3)_n—O—]_m—H$$

wherein n is an integer from 1 to 5, m is an integer from 1 to 8, and $R_1$, $R_2$, and $R_3$ may each be hydrogen, alkyl, aryl, aralkyl, alkylaryl, and mixtures thereof and having a molecular weight less than about 400.

5. The process of claim 4 wherein said solvent further comprises a polyalkylene glycol ether cosolvent of the formula:

$$R_4O—[CHR_5—(CHR_6)_x—O]_y—R_7$$

wherein $R_4$, $R_6$, and $R_7$ may each be hydrogen, arkyl, aryl, aralkyl, alkylaryl, and mixtures thereof with the proviso that $R_4$ and $R_7$ are not both hydrogen; x is an integer from 1 to 5; and y may be an integer from 2 to 8 and said solvent comprises between 0.5 and 99 percent by weight of said glycol ether solvent.

6. The process of claim 1 wherein said lean solvent comprises pentaethylene glycol.

7. The process of claim 1 wherein said lean solvent comprises tetraethylene glycol.

8. The process of claim 1 wherein said FCC gasoline comprises aromatics and olefins and said raffinate stream is reduced in aromatics relative to said mixture.

9. The process of claim 8 wherein said extract stream comprises aromatics and olefins.

10. The process of claim 1 wherein the FCC gasoline fraction is selected from the group consisting of light, heavy, and full range FCC gasoline.

11. The process of claim 1 wherein the sulfur impurities are selected from the group consisting of mercaptans, sulfides, disulfides, thiophenes, benzothiophenes, and mixtures thereof.

12. A process for the extraction of sulfur compounds from a hydrocarbon feedstream comprising aromatics and sulfur compounds and said feedstream comprising fractions boiling between about C5 to 216° C., said process comprising the following steps:

a) passing the hydrocarbon feedstream to an extraction zone and therein contacting said feedstream with a first lean selective solvent including a component selected from the group consisting of tetraethylene glycol, pentaethylene glycol, methoxytriglycol and mixtures thereof to provide a rich-solvent stream enriched in sulfur relative to said feedstream and a raffinate stream;

b) passing said rich-solvent stream to a flash reboiled zone to provide a first overhead stream and a second rich-solvent stream;

c) passing said second rich-solvent stream to a reboiled distillation zone and therein contacting said second rich-solvent stream with a stripping medium to provide a second lean-solvent stream and a second overhead stream comprising hydrocarbons and sulfur compounds;

d) admixing said first overhead stream and at least a portion of said second overhead stream to provide a mixed overhead stream and cooling and condensing said mixed overhead stream to provide a sulfur-rich hydrocarbon stream and a first aqueous stream;

e) admixing at least a portion of said first aqueous stream with said raffinate stream to provide a raffinate admixture and cooling and separating said raffinate admixture to provide a lean hydrocarbon stream and a second aqueous stream;

f) passing at least a portion of said second aqueous stream to said reboiled distillation zone to provide said stripping medium; and g) returning at least a portion of said second lean solvent stream to said extraction zone to provide said first lean solvent stream.

13. The process of claim 12 further comprising heat exchanging the rich-solvent stream with said solvent stream to reduce the temperature of said second lean solvent stream to said extraction temperature.

14. The process of claim 12 wherein the extraction zone is operated at a temperature range between about 20° C. and 200° C. and a pressure range between 200 kPa and about 1.1 MPa.

15. The process of claim 12 wherein the sulfur content of the hydrocarbon feedstream ranges between about 50 ppm-wt sulfur and about 3000 ppm-wt sulfur.

16. The process of claim 12 wherein the lean hydrocarbon stream comprises less than about 200 ppm-wt sulfur.

17. The process of claim 12 wherein the lean hydrocarbon stream comprises less than about 50 ppm-wt sulfur.

18. A process for the removal of sulfur impurities from a mixture thereof with an FCC gasoline fraction said process comprising:

a) at least partially vaporizing said mixture and contacting said mixture in an absorption zone with a lean solvent selected from the group consisting of a polyalkylene glycol, a polyalkylene glycol ether and mixtures thereof having a molecular weight less than 400 to provide a raffinate stream having a reduced sulfur content relative to said mixture and a rich-solvent stream enriched in said sulfur impurities;

b) passing said rich-solvent stream to a flash reboiled zone to provide a second rich-solvent stream and passing said second rich-solvent stream to a stripping zone and therein contacting said second rich-solvent stream with a stripping medium to produce an extract phase comprising said sulfur impurities and a stripped solvent stream depleted of said impurities;

c) separating said extract phase into an extract product and a first aqueous phase and washing said raffinate stream with at least a portion of said first aqueous phase to provide a raffinate product and a second aqueous phase;

d) passing at least a portion of said second aqueous phase to said stripping zone as said stripping medium; and, e) returning at least a portion of said stripped solvent stream to said absorption zone as said lean solvent.

* * * * *